United States Patent [19]

Olsson et al.

[11] 4,110,954

[45] Sep. 5, 1978

[54] HORIZONTAL PACKAGING APPARATUS

[75] Inventors: Jan Christer Holger Olsson, Braemhult; Karl Gunnar Carlson, Vaestra Froelunda, both of Sweden

[73] Assignee: Tex Innovation AB, Goteborg, Sweden

[21] Appl. No.: 792,348

[22] Filed: Apr. 29, 1977

Related U.S. Application Data

[63] Continuation-in-part of Ser. No. 735,551, Nov. 1, 1976, which is a continuation-in-part of Ser. No. 669,147, Mar. 22, 1976.

[30] Foreign Application Priority Data

Mar. 30, 1977 [CA] Canada ..... 275130

[51] Int. Cl.[2] ..... B65B 31/02; B65B 63/02; B65B 9/02

[52] U.S. Cl. ..... 53/433; 53/436; 53/450; 53/511; 53/526; 53/529; 53/523; 53/548

[58] Field of Search ..... 53/22 A, 24, 28, 112 A, 53/124 A, 124 D, 124 TS, 124 CC, 180 R

[56] References Cited

U.S. PATENT DOCUMENTS

| | | | |
|---|---|---|---|
| 3,837,138 | 9/1974 | Terry | 53/124 CC X |
| 3,848,398 | 11/1974 | Suhr | 53/124 CC X |

*Primary Examiner*—Travis S. McGehee
*Attorney, Agent, or Firm*—McFadden, Fincham & Co.

[57] ABSTRACT

There is provided an apparatus for wrapping commodities, which may be compressible, and a corresponding method, in which a commodity is conveyed along a fixed path, a pair of opposed lengths of wrapping material are fed in an opposed relationship and in registry, the commodity is inserted between the opposed lengths of the wrapping material which have a leading end which has been sealed to form an open-sided and open-trailing end envelope, the lateral sides of the wrapping material are then sealed, and thereafter, a bag length is severed from the pair of lengths of wrapping material and sealed. Preferably, the commodity is fed under compression in between the opposed lengths of wrapping material, maintained under compression while the wrapping material is side-sealed and is vacuum-packaged while also under compression.

24 Claims, 20 Drawing Figures

HORIZONTAL PACKAGING APPARATUS

This application is a continuation-in-part of co-pending application Ser. No. 735,551, filed Nov. 1, 1976, which is a continuation-in-part of co-pending application Ser. No. 669,147, filed Mar. 22, 1976, now abandoned. su This invention relates to a method and apparatus for wrapping commodities.

More particularly, this invention relates to an apparatus and method suitable for compression packaging and vacuum wrapping compressible commodities.

The packaging of various types of commodities, specifically consumer goods, industrial goods or the like, is an essential necessity in the manufacture and distribution of such commodities between the point of manufacture and the point of sale, or the point of use, as the case may be. Transportation and handling costs have, in recent years, increased significantly and as a result, the cost of goods where the latter have to be transported any distance has increased due to the increased cost of transportation. Transportation costs, as well as handling costs, are not only dependent on the weight of such products, but also on the volume of space such goods occupy. Thus, in the case of bulky goods, it has long been recognized that the concept of reducing the bulk of volume of such goods for transportation and handling purposes can reduce the overall costs and lead to a much more efficient transportation and handling concept. Several proposals have been made in the prior art for reducing the volume of bulky goods and reference may be had to e.g., U.S. Pat. No. 3,511,021 which refers to the fact that it is desirable to reduce the volume of bulky goods for transportation. However, inasmuch as technology has evolved to propose various systems for reducing the volume of goods for transportation, heretofore very few systems have met with any public acceptance, for one reason or another.

As a case in point, one may refer to the fact that bulky articles such as insulation material of glass fiber or the like, cushions or the like, can be theoretically reduced to a very small fraction of their initial volume after manufacture but even under today's conditions, such products are only compressed and then wrapped to a relatively small reduction in their original thickness and while this reduction aids somewhat in the reduction and transportation costs, it by no means reduces the volume to a small fraction of the original volume of goods which could significantly reduce the costs of transportation further.

With this invention, according to one embodiment thereof, applicant has developed an apparatus for compression wrapping and vacuum packaging compressible commodities which is capable of compressing such commodities to a fraction of their original size and which results in reduced handling and transportation problems; in accordance with a further aspect, there is provided a method of vacuum packaging and compressing compressible commodities which can be carried out using the apparatus of this invention and which likewise achieves many advantageous features, which will be described hereinafter in greater detail.

Broadly stated, an apparatus according to this invention comprises means for supplying a length of flexible wrapping material, means for advancing a commodity along a fixed path and for enveloping the commodity with the length of wrapping material to wrap the commodity as the commodity is advanced, whereby the commodity is positioned between a pair of layers of the wrapping material having free lateral edges and free trailing edges, means for forming side seals in the free lateral edges of the pair of layers of wrapping material, means for subjecting the resulting side sealed enveloped commodity to a partial vacuum and means for sealing the free trailing edges of the resulting vacuum-treated wrapped commodity to form a vacuum-packaged commodity.

In accordance with the method of the present invention, there is provided the steps of supplying a length of flexible wrapping material, advancing a commodity along a fixed path, enveloping the commodity with a pair of layers of the wrapping material to envelop the commodity so as to form a commodity within an envelope in which the envelope has a leading end which is sealed formed by a seal between the opposed lengths of a pair of wrapping material lengths, and with an open trailing end, whereafter the envelope is side-sealed, a bag-length is cut from the lengths of flexible wrapping material, and subsequently the commodity is then sealed in the envelope by sealing the open trailing end.

In greater detail of the method and apparatus of the invention, the means for supplying a length of flexible wrapping material preferably comprises means for supplying a pair of opposed continuous lengths of wrapping material which are general registry. The wrapping material may be any suitable wrapping material for this purpose — in the embodiments envisioned by this invention, the wrapping material is preferably of an air-impermeable nature and comprises a thermoplastic material capable of heat-sealed. To this end, typical materials which may be utilized in the present invention include the thermoplastic materials such as polyethylene or copolymers thereof, polypropylene or copolymers thereof, etc.

The thickness of the wrapping material may vary according to the required parameters for the wrapping for the commodity and thus is within the skill of those skilled in the art.

In supplying a pair of opposed lengths of wrapping material, both are preferably supplied from a continuous roll of the same. The opposed lengths are brought together in registry in a spaced-apart manner which will permit the feeding of the commodity in between the opposed layers of the wrapping material. Prior to feeding the commodity between the opposed layers of wrapping material, the opposed layers are preferably sealed or otherwise secured together at the leading end in the direction of movement of the commodity so that as to provide a closed leading end. Suitable means may be provided for sealing the leading end — to this end, such means preferably comprise heat-sealing means.

In defining a fixed guide path for the advancement of the commodity, suitable means for conveying the commodity along the fixed guide path are preferably employed — such means may be — e.g. conveyors, movable belts or the like. Where it is desired to compress the commodity for maximum reduction in thickness of the commodity, a compressible commodity may be subjected to a compression step with compression means during the feeding of the same to the packaging operation — for example, a pair of opposed conveyor belts may be arranged in a converging manner to subject the commodity to compression to the desired degree and when compressed, the advancing means for the commodity may then feed the commodity between the opposed layers of wrapping material in a compressed state.

In the second stage of operation, the commodity is inserted between the opposed layers of the wrapping material and the wrapping material and the commodity is then advanced to a side-sealing component. In the case where the commodity is placed under compression, the advancing means preferably includes means for retaining the commodity under compression while the side edges are sealed. In a preferred arrangement, there are provided means for engaging the closed leading end of the wrapping material and advancing the same in conjunction with the advancing means for the commodity into engagement or operative relationship with the side-sealing means. Such means preferably comprise retractable fingers or grippers for engaging the interior surface of the pair of layers of wrapping material and for controlling and/or advancing the same into the sealing operation. Such fingers are preferably of a reciprocal nature adapted to advance a bag length of material into operative relationship with the sealing operation and thereafter retract to the original position to subsequently engage a further closed leading end.

In the side-sealing operation, the pair of layers of wrapping material with the commodity placed between the pair of layers, is subjected to a sealing step using sealing means such as sealing elements. The sealing element can be any suitable type well known to those skilled in this art, and preferably operates in conjunction with means for severing bag lengths of material from the continuous supply or lengths of wrapping material. Thus, in a preferred construction, the means for severing the bag lengths of material are preferably located between the compression means and the sealing means whereupon movement of the commodity into the sealing step or position will expose the lengths of wrapping material to the cutting operation. At the same time, there is preferably included means for creating a seal widthwise of the wrapping material to form the leading seal for the subsequent operation; these are located downstream of the cutting means whereby the severing-/sealing operation forms a bag length for a commodity previously placed between the opposed layers of wrapping material and a closed bag length for the subsequent envelope in which a commodity is to be subsequently inserted.

In a preferred version of the sealing means, advancing means for the retaining of control of the commodity between the opposed layers of wrapping material are preferably provided operating in conjunction with the advancing means for advancing a commodity between the opposed layers of wrapping material. To this end, a pair of opposed conveyor belts having a desired height may be provided and which will retain the commodity under compression. In this manner, the commodity is thus advanced along a continuous fixed path from the initial loading station to the sealing operation and sealing station.

Upon completion of the sealing of the free lateral edges of the wrapping material, there is thus obtained an envelope having sealed side edges and a sealed leading edge with an open-trailing end (upon completion of the severing of the bag length of the wrapping material). Thereafter, there are preferably provided means for advancing the commodity into the final sealing operation to seal the open trailing end of the envelope and form the wrapped commodity and in a preferred embodiment, in this last operation there are preferably provided vacuum packaging and sealing means operating in conjunction with each other. The vacuum packaging means preferably comprises a fixed surface and an opposed movable surface, with a vacuum chamber being defined between the two surfaces or alternately, in a housing enclosed the two surfaces. The sealing means, in the latter embodiment, are preferably included in the vacuum chamber and means are provided for advancing the commodity from the side-sealing operation into the vacuum chamber and subsequently for discharge of the wrapped commodity from the vacuum chamber. In the preferred embodiment just described, means are provided for causing at least one of the surfaces to be brought into and out of engagement with the other — preferably such means operate to bring the non-fixed surface into engagement with the fixed surface. The non-fixed surface preferably comprises a flexible air-impermeable membrane of suitable rubber or thermoplastic material, which is dimensioned so as to flex and upon creation of a vacuum between the opposed surfaces, to contact the commodity to be wrapped under compression and vacuum in such a manner as to "squeeze" the air from the envelope containing the commodity. Suitable means for creating a vacuum may be provided.

The method and apparatus of the present invention, hereinafter described in greater detail with reference to the drawings and illustrating preferred embodiments, has been found to be very useful for packaging commodities under compression. Thus, for example, insulation material such as glass fiber batts or the like, cushions or the like, may be compressed to a fraction of their original volume with the apparatus and method of the present invention in a very simple and fast manner.

The various components of the apparatus of the present invention, and likewise the various steps of the method of the present invention, can be carried out in a time-related manner. Thus, for example, one commodity can be fed between a pair of layers of opposed lengths of wrapping material, while a commodity previously inserted is acted on to side-seal the lengths of wrapping material and a still further commodity is subjected to a vacuum packaging operation. Thus, suitable control means may be provided for operating the apparatus in such time-related sequence.

The present invention provides an economical apparatus and a relatively simple apparatus which is capable of vacuum-packaging and compressing various types of high volume compressible commodities. Different types of commodities may be employed from clothing, or garments in general, etc.

Having thus generally described the invention, reference will now be made to the accompanying drawings, illustrating preferred embodiments and in which.

Figure 14:
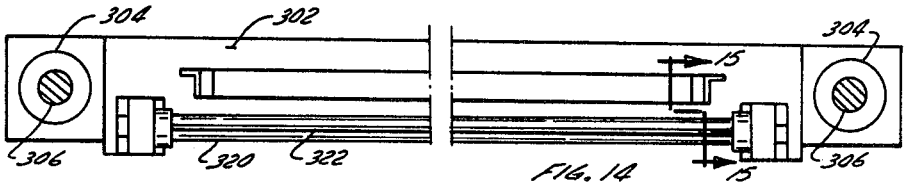
Figure 15:
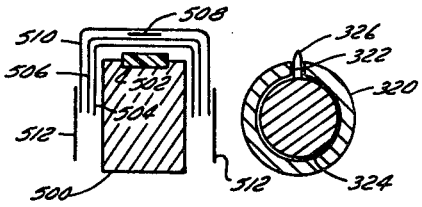
Figure 5:
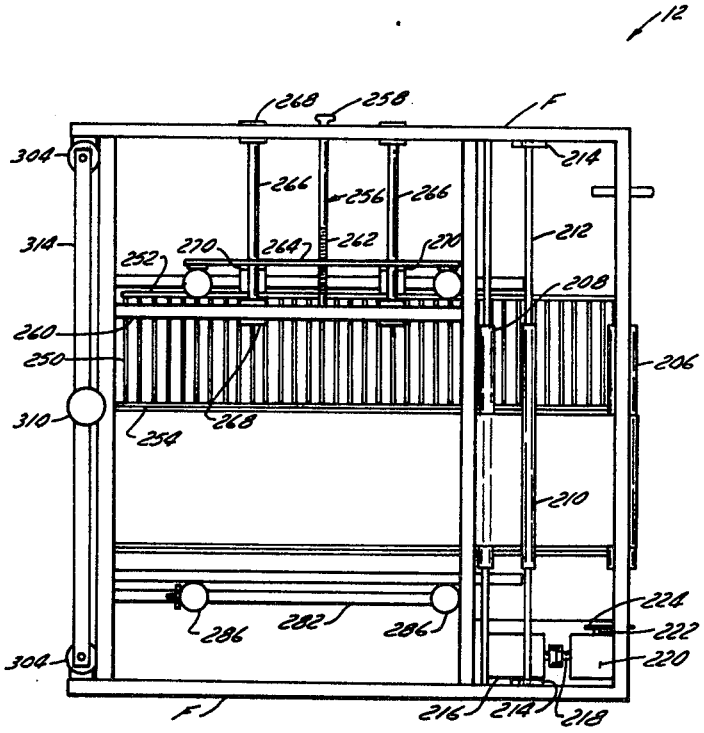
FIG. 5 is a top plan view of the apparatus of FIGS. 3 and 4.
Figure 6:
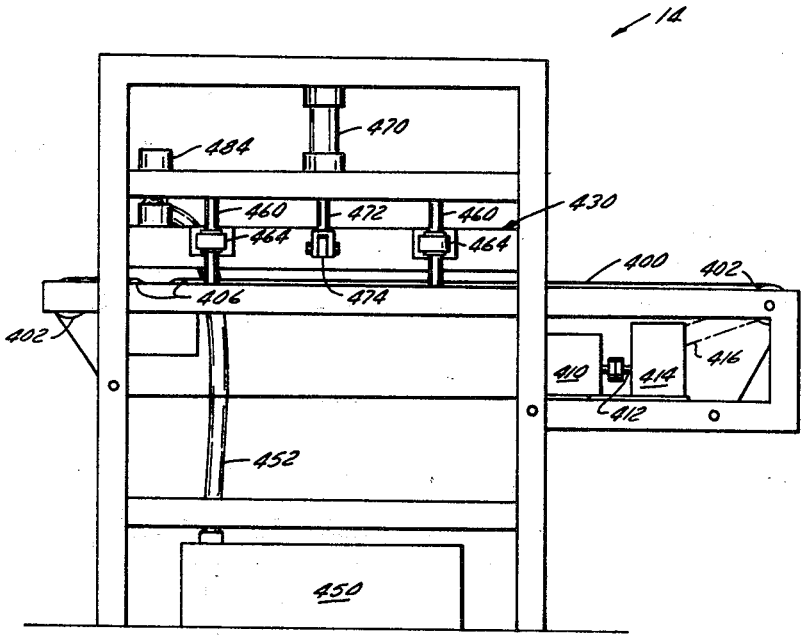
FIG. 6 is a side elevational view of the vacuum sealing device.

FIG. 14 appearing on the same sheet as FIG. 5, illustrates schematically the sealing and cutting assembly;

FIG. 15 is a section taken along the line 15—15 of FIG. 14;

Referring now in greater detail to the drawings, and FIG. 13 initially, the three assemblies used in the overall apparatus of this invention are indicated generally by reference numeral 10 to designate the compression and commodity-feeding device; reference numeral 12 designates the side sealing and advancing assembly; and reference numeral 14 designates the vacuum packaging and sealing apparatus. The wrapping material and commodity-feeding assembly indicated by reference numeral 10 is shown in greater detail in FIGS. 1 and 2 and includes, for reference purposes, frame members indicated by reference letter F and throughout this description, such frame members will be referred to in general by reference letter F. A pair of continuous-length rolls of suitable wrapping material — for example, plastic material, are indicated by reference numerals 20 and 22 which are mounted on a pair of rotatable rollers 24 and 26, journalled between opposed frame members F by means of axles 28 and 30. A length of the flexible wrapping material is withdrawn from the roll and forms a web W so that top and bottom webs are fed to the bag-forming operation, as explained hereinafter in greater detail.

Figure 1:
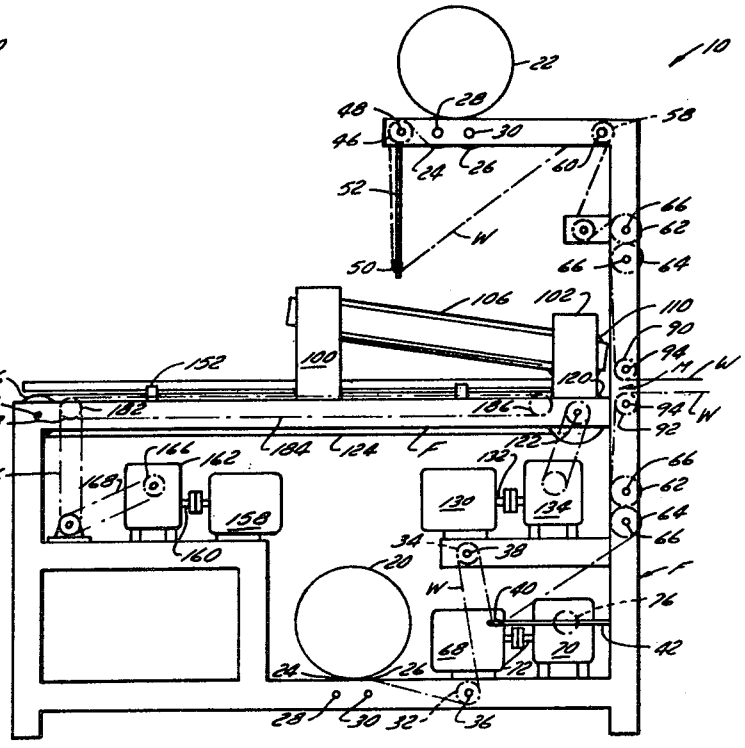
FIG. 1 is a side elevational view of one assembly of the apparatus.

Guide rollers 32 and 34, journalled on shafts 36 and 38 between opposed frame members, are located to provide a path of travel for the web W from the supply thereof to the bag-forming operations. The lowermost section of the assembly, as shown in FIG. 1, includes an idler and tensioning arm or rod 40 supported on an arm 42 extending from the frame F of the apparatus, and the web W passes in engagement with the arm 40. In a similar manner, the web W emanating from the upper roll 22 of wrapping material passes over a guide roller 46 journalled on a shaft 48 between opposed frame members; a pair of tensioning and idling arms 52 connected by means of a rotatable arm 50, are located in the path of travel of the web W from the guide roller 46. Thereafter, the web W passes over a further guide roller 58 journalled on the shaft 60 rotatably mounted between a pair of opposed frame members.

The drive means for the upper and lower webs W are provided by a pair of cooperating rollers 62 and 64, journalled on shafts 66, at least one of the rollers 62 and 64 being driven by means of a motor 68 connected to a gear box 70 through shaft 72. The output shaft of the gear box 70 includes a drive shaft 74 mounting a sprocket 76, which in turn, mounts a drive chain 78 which rotates about a further sprocket or the like 80 journalled on shaft 66 of one or both of the drive rollers 64 and 62. A second sprocket 82 mounted on the shaft 66 journals a further drive chain 84 which is operatively associated with a sprocket 86 connected to the shaft 66 of the upper drive rollers 62 and/or 64 to thereby rotate the upper rollers 64 and 62.

A feed path for the two web lengths is established by means of a pair of opposed spaced apart rotatable rollers 90 and 92, journalled on shafts 94, mounted between opposed frame members F of the apparatus. As shown in FIG. 1, two webs of material are fed over the various guide rollers and between the spaced apart rollers 90 to form a "mouth", which will be explained hereinafter in greater detail.

Figure 2:
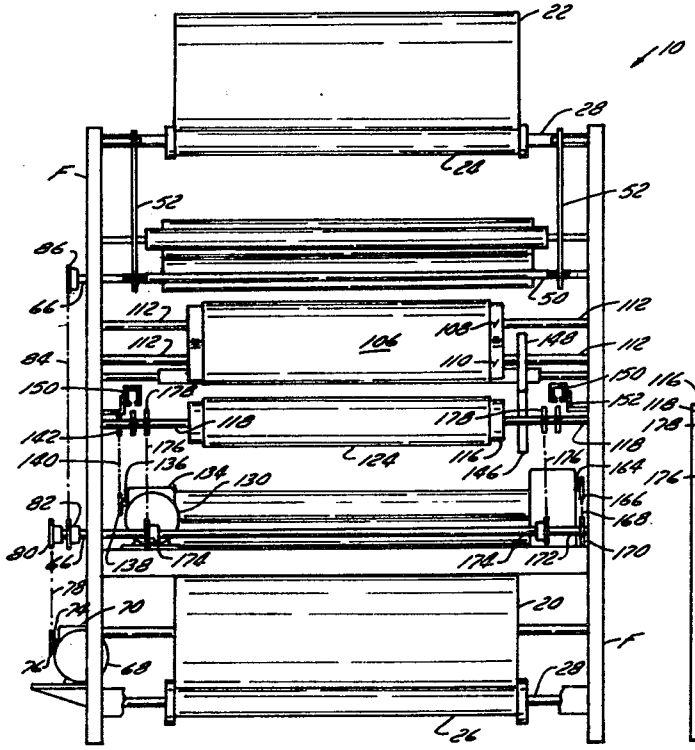
FIG. 2 is an end elevational view of the apparatus of FIG. 1.
Figure 3:
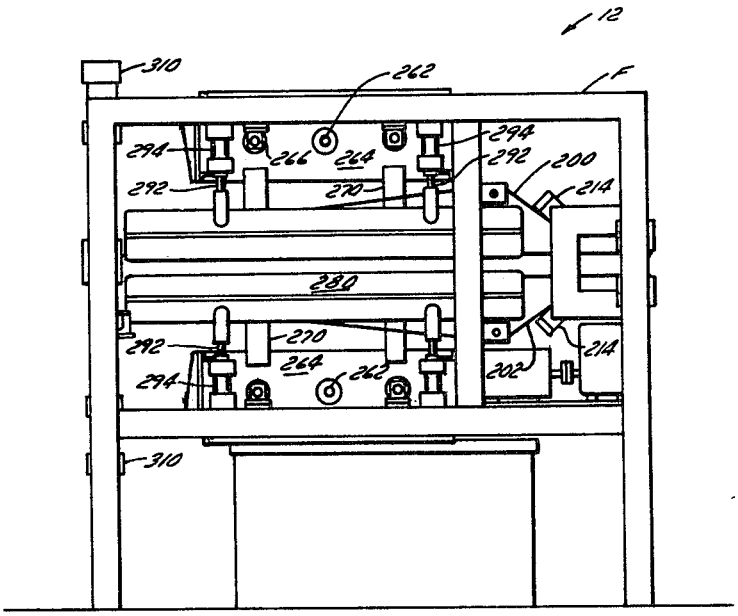
FIG. 3 is a side elevational view of the side sealing assembly of the apparatus.

The apparatus illustrated in FIGS. 1 and 2 includes a compression section which is particularly suitable for compressing commodities such as pillows, cushions or the like. To this end, the apparatus includes a pair of spaced apart upwardly extending frame members 100 and 102 connected to the frame F, and which support an upper movable belt 106 extending and rotating between the frame members 100 and 102. The belt 106 rotates between a pair of spaced apart rollers 108 and 110, each journalled on a shaft 112. As will be seen from FIG. 1, the roller 108 is at a higher elevation from that of roller 110 whereby the belt 106 forms a decreasing angle towards the discharge end at support 102, adjacent to the mouth formed between the webs W and which will be hereinafter referred to by reference letter M.

The lower commodity advancing means operating in conjunction with the belt 106 comprises a front roller 116 journalled on a shaft 118 and a further roller 120 journalled on a shaft 122 at the opposed end (the discharge end) adjacent the mouth M and located generally beneath the roller 110. A continuous belt 124 extends between the rollers 116 and 120. The drive system for the upper and lower rotatable belts may be seen in FIG. 1 and comprises a motor 130 connected by means of a drive shaft 132 to a gear box 134 which includes an output shaft 136 journalling a sprocket 138 and mounting a chain drive belt 140. The chain belt 140 is journalled on a further sprocket 142 mounted on the shaft 122 of the roller 120. The shaft 118, at its opposite end, includes a gear 146 mounted thereon, meshing with a further gear 148 mounted on shaft 112 journalling the roller 110. In this manner, the upper and lower belts are simultaneously rotated so as to advance a commodity C placed on the belt 124 towards and into engagement with the belt 106 to compress the same as it advances towards the mouth M at the discharge end.

Referring now to FIGS. 1, 2 annd 10, there is provided on either side of the belts 106 and 124, a pair of guide channels 150 of a generally inverted U-shape, which are fixedly secured to the frame F by means of brackets 152. Mounted in each of the channels 150 is an elongated slidable member 154 adapted for reciprocating movement therein. The members 154 have, at the projecting end thereof, a finger 156 pivotably associated therewith as will be described hereinafter with reference to FIGS. 11 and 12. The member 154 is adapted for reciprocating movement, as aforementioned, in channel 150 and movement is effected by means of a motor 158 driving a shaft 160 which in turn, is connected to a gear box 162. The output shaft 164 of the gear box journals a sprocket 166 which there is mounted a chain drive belt 168. The chain drive is connected to a sprocket 170 journalled on shaft 172, which in turn, is journalled between opposed frame members F of the apparatus. Shaft 172, on each side, carries a further pair of sprockets 174, mounting a chain drive 176 which in turn, is associated with a further pair of sprockets 178. Sprockets 178 are mounted on a shaft 180 journalled between opposed frame members of the apparatus and shaft 180 journals a further sprocket 182 with a chain belt 184 associated therewith and rotating between sprocket 182 and a further sprocket 186 journalled on a further shaft 188 at the leading end of the movable member 154. Chain belt 184 includes at least one upwardly standing finger or like projection 190 fixedly secured thereto, which in turn, engages the member 154 through the open-mouth in the bottom of the channel 150. Upon reciprocating movement of the chain drive 184 (and conversely through the other chain drives), the finger 190 will be effective to advance and retract the movable member 154 in the channel 150.

Figure 11:
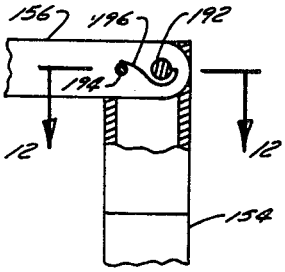
FIG. 11 is a detailed view showing a portion of the advancing apparatus illustrated in FIG. 10.
Figure 12:
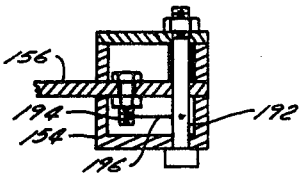
FIG. 12 is a section taken along the line 12—12 in FIG. 11.

As shown in FIG. 11, the finger 156 is pivotably connected to the member 154 on a shaft 192. The finger 156 is mounted to the reciprocating member 154 in a biased position whereby the finger 156 is normally urged into horizontal alignment with the member 154; to this end, the finger 156 includes a pin or bolt 194 to which is fixedly attached one end of a spring 196; the opposed end of the spring 196 is fixedly secured to the pivot 192 journalling the finger 156 to the arm 154.

The bag-forming, side sealing and advancing unit, indicated generally by reference numeral 12, will be seen in greater detail in FIGS. 3, 4, 5, 14 and 15 and to this end, the unit includes guide rollers 204, 206 and 208 defining a guide path over which the belts rotate. Rollers 204, 206 and 208 are mounted on suitable shafts extending between opposed frame members. A further roller 210 forming a tension roller, for each of the upper and lower belt systems, may be included (see FIG. 5), rollers 210 being mounted on shafts 212 which are, in turn, journalled by adjustment blocks 214 attached to the frame, the adjustment blocks permitting adjustment of the amount of tension on the belts 200. The belts 200 are driven by means of a motor 216 connected to a shaft 218 which in turn, is connected to a gear box 220. The gear box 220 includes an output shaft 222 mounting a sprocket or the like 224, which in turn, journals a chain drive 226. The chain drive 226 is mounted over a further sprocket 228 fixed on a shaft 230 which supports the bottom front roller 206. At the opposed end of the shaft 230 there is provided a gear 232, meshing with a further gear 234 journalled on shaft 236 mounting the upper roller 206. In this manner, both the upper and lower shafts 206 are rotated simultaneously.

Figure 4:
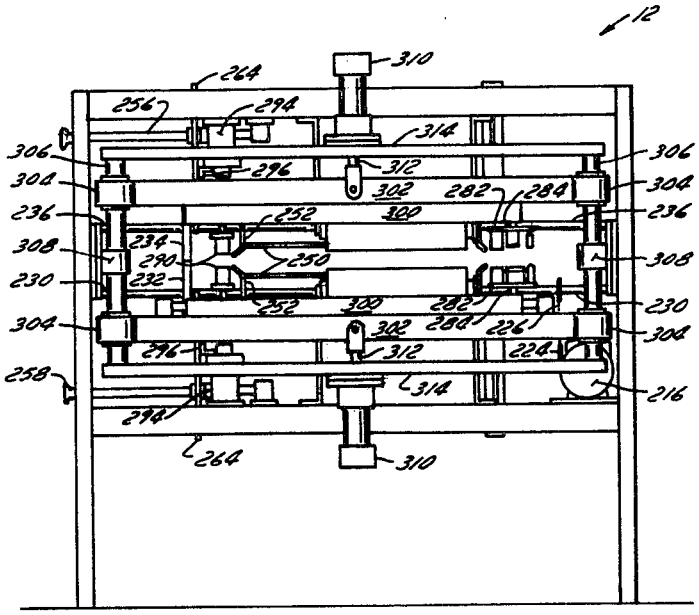
FIG. 4 is an end elevational view of the apparatus of FIG. 3.

In accordance with an optical feature of the present invention, the supports for the belts 200 may be varied in width and to this end, the apparatus includes a mechanism illustrated in greater detail in FIGS. 4 and 5. A plurality of spaced apart rods 250 fixedly secured to a frame member 252, operate in conjunction with a further frame member 254 containing a plurality of apertures sized to receive the rods 250. As illustrated in FIG. 5, the rods 250 preferably extend the full length of the belts 200 and can provide, if desired, an adjustment permitting articles of greater width to be processed in the assembly 12. As illustrated in FIG. 4, both the upper and lower portions of the apparatus may include the rods 250 to provide an extension for the upper and lower belts. Frame member 252 is movable by means of a screw thread device 256 mounted to the frame member F of the apparatus and which is manually rotatable by means of handle 258. The opposed end of the screw thread device 256 is journalled to frame member 260; the screw threads 262 threadably engage a mounting plate 264 which is movable laterally along the screw axis of the member 256 as the latter is rotated. Guide rods 266 slidably mount the plate 264; the rods 266 are journalled to frame member F and frame member 260 by means of bushings 268. Mounting member 264 is fixedly secured to plate 252 by means of brackets 270.

The assembly 12 includes sealing means for sealing the lateral side edges of a wrapped commodity as it is advanced to and through the assembly 12. To this end, there are included two pairs of spaced apart lateral side sealing means illustrated in FIG. 4. As viewed from FIG. 4, the sealing units 280 comprise a pair of spaced apart sealing heads, each of which is mounted on a plate 282. Each plate 282 is mounted on a piston shaft 284 connected to a pneumatic piston assembly 286, one being located at either end (see FIG. 5).

The pair of sealing heads illustrated to the left hand side of FIG. 4 comprise an adjustable pair of sealing heads, each of which is indicated by reference numeral 290. Each of these sealing heads is mounted by means of a pair of spaced apart piston rods 292, which are actuated by a pneumatic cylinder 294. The cylinders 294 are mounted to the supporting plate 264 by means of a bracket 296. In this manner, the sealing heads are made adjustable to accommodate different widths as desired by movement as heretofore described.

The assembly 12 includes, in conjunction with the assembly 10, a sealing device and severing means adapted to form a leading seal between the pair of webs W, and to sever the sealed webs prior to advancing the same into the assembly 12. To this end, there is provided a pair of spaced apart sealing heads 300 each fixedly secured to a frame member 302 extending transversely across the webs W. The frame members 302 are journalled by means of bushings 304 on a vertical guide rod 306. The guide rods 306 are fixedly secured, intermediate their ends, by means of a further bushing 308. Movement of the supporting members 302, and hence the sealing heads, is achieved by means of a pneumatic cylinder 310 journalling a piston rod 312, which is fixedly secured to the supporting brackets 302 as illustrated in FIG. 4. As illustrated in FIG. 4, the ends of the shafts 306 may be supported further by means of a supporting member 314 extending between guide rods 306.

The cutting assembly, illustrated in part in FIG. 4, and in greater detail in FIGS. 14 and 15, preferably comprises a device known in the art as a "orega" assembly. As such, a pneumatic tube 320 containing a slit 322 therein, is mounted by a suitable bracket connected to the lower frame member 302 of the sealing head. Mounted interiorly of the member 320 is a piston member 324, which contains a knife or similar cutting device 326 ejecting through the aperture 322. The piston member 324 is freely slidable within the member 320 between its opposed end. Means are provided at each end of the tube (not shown) for selectively admitting pressurized air for driving the piston the length of the tube, to sever the webs.

The vacuum packaging and sealing unit is illustrated in FIGS. 6 through 9 in detail and includes a movable belt drive for conveying a commodity between opposed pairs of web sections and delivered from the assembly 12. The belt is indicated by reference numeral 400 and is rotatable between guide rollers 402 on the top, guide rollers 404 on the bottom, and guide rollers 406 for directing the belt down and around a sealing head (to be described hereinafter). Drive means for the belt 400 is achieved through a motor 410 driving a shaft 412 connected to a gear box 414, with an output shaft (not shown) mounting a sprocket and in turn, journalling a chain belt 416 rotating, at one end, about a sprocket 418 journalled on a shaft 420 which mounts roller 402. Shaft 420 is journalled between opposed frame members F. The belt 400 passes over a supporting plate 424 fixedly secured to frame members of the assembly (see FIGS. 8 and 9) and forms the bottom or bed of the vacuum chamber (i.e., it forms a fixed non-compressible surface). The upper portion of the vacuum chamber is defined by means of a housing 430, surrounding the conveying assembly. The side walls 432 of the housing 430 mounts a flexible membrane 434 spaced upwardly from the lower edges of the side walls 432; the membrane 434 is secured to the side walls by means of a flange 438 and appropriate fastening means such as bolts or the like 438. The lower edge of the side walls 432 includes a further flange 440 having fixedly secured thereto a gasket or other like sealing material, extending about the periphery of the housing 430. In this manner, the gasket is intended to form with the supporting plate 424 an air-tight enclosure.

One of the side walls 432 is in communication, via apertures 444, with a vacuum chamber indicated generally by reference numeral 446. The chamber 446 is connected to a vacuum pump 450 by means of a conduit 452.

The housing 430 is movable vertically from a raised position to a closed position; to this end, the housing 430 is journalled on shafts 460 by means of bushings 464. The shafts 464 are fixed at each end to supporting members 466 which in turn are fixed to frame members F whereby the housing 430 is free to slide up and down on the shafts 460. Movement is effected by means of a piston assembly 470 mounting a piston rod 472 which is fixedly secured to the housing 430 by means of a bracket 474.

Figure 7:
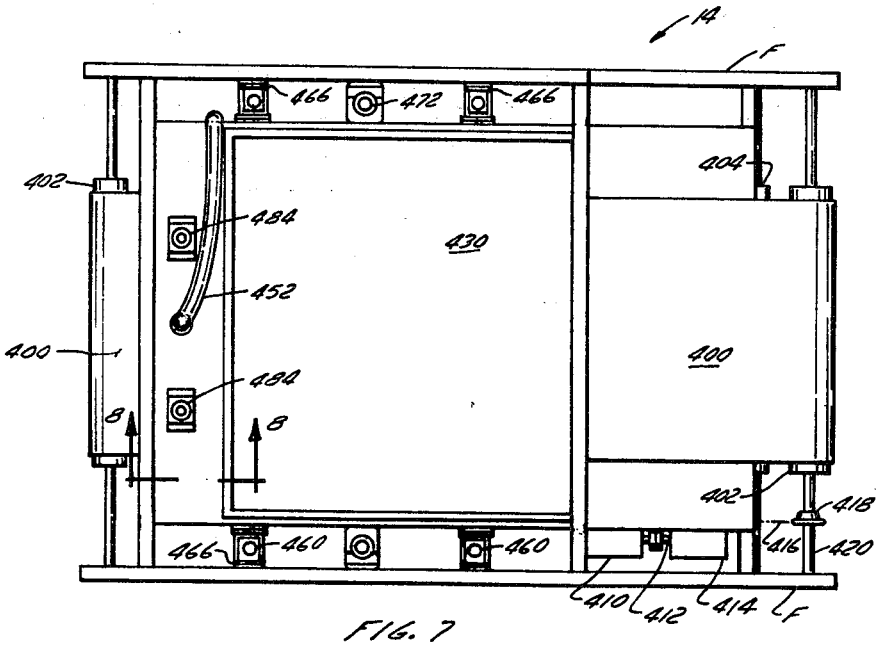
FIG. 7 is a top plan view of the device of FIG. 6.
Figure 8:
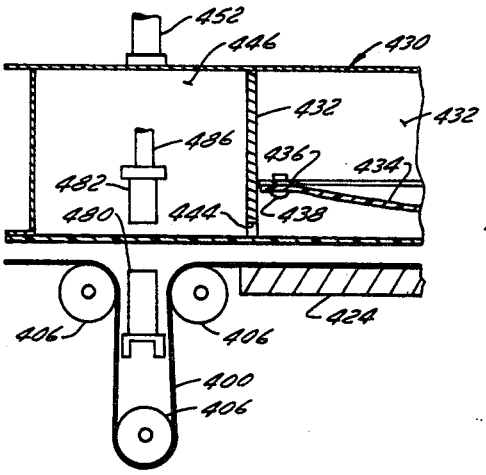
FIG. 8 is a cross sectional detailed view of a portion of the vacuum packaging and sealing unit taken along the line 8—8 of FIG. 7.
Figure 9:
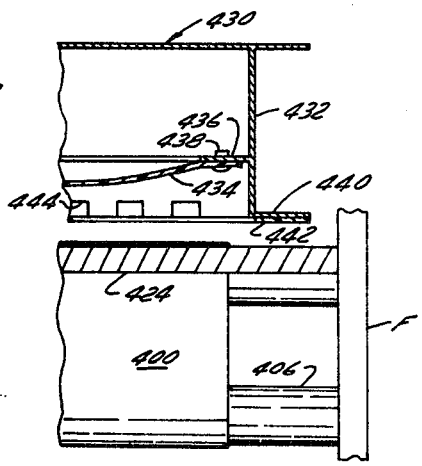
FIG. 9 is a view similar to FIG. 8 but showing further detail of the vacuum packaging assembly.
Figure 10:
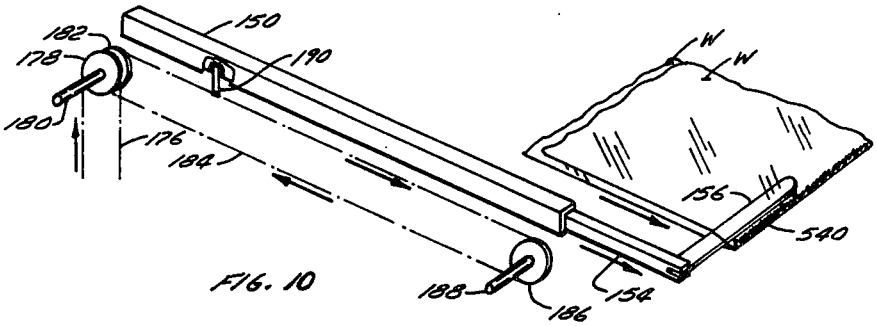
FIG. 10 is a schematic view showing a portion of the wrapper advancing mechanism employed in the apparatus of FIG. 1.

As illustrated in FIGS. 7 and 8, there are provided sealing means for sealing the trailing end of the wrapped commodity received in the assembly 14; to this end, there are provided a pair of spaced apart sealing heads 480 and 482, the lower of which is fixedly secured to a frame member and the upper of which is movable. As will be seen from FIG. 8, the lower sealing head is journalled between opposed sections of the belt 400 (which forms a portion of the vacuum chamber at the point where it extends downwardly as illustrated in FIG. 8). The upper sealing head 482 is movable and is adapted to be brought into engagement with the lower sealing head 480 by means of a pair of piston assemblies 484, attached thereto by means of piston rod 486.

The construction of the sealing head is illustrated in greater detail in FIG. 15 and includes a supporting or backing member 500 of suitable material; a resilient backing member 502 is partially embedded in the body 500 with an overlying wire mesh layer 504 surrounding the member 502. The mesh serves as a heat dissipating member, and is covered with a backing layer 506 of suitable material. The heating element 508 is mounted over the backing member 502 on the backing layer 506 and is covered by means of a facing material of suitable characteristics as indicated by reference numeral 510. The layers of various material may be fixedly secured to the body 500 by means of suitable tape or the like 512.

Referring now to FIGS. 13A through 13F, the operation of the apparatus described above is illustrated in detail. To this end, referring initially to FIG. A, a commodity C is shown as being fed onto the advancing belt 124 for processing; in commencing the operation of the apparatus, it will be noted from FIG. 13A that the pair of webs W are initially sealed at their leading ends (prior to entry into the side-sealing and advancing assembly 12) from a previous operation of the unit — the seal on the web being indicated generally by reference numeral 540. As the commodity C is advanced along the belt 124, it engages with the moving belt 106 and is subject to compression by virtue of the converging belts 124 and 126.

Figure 13A:
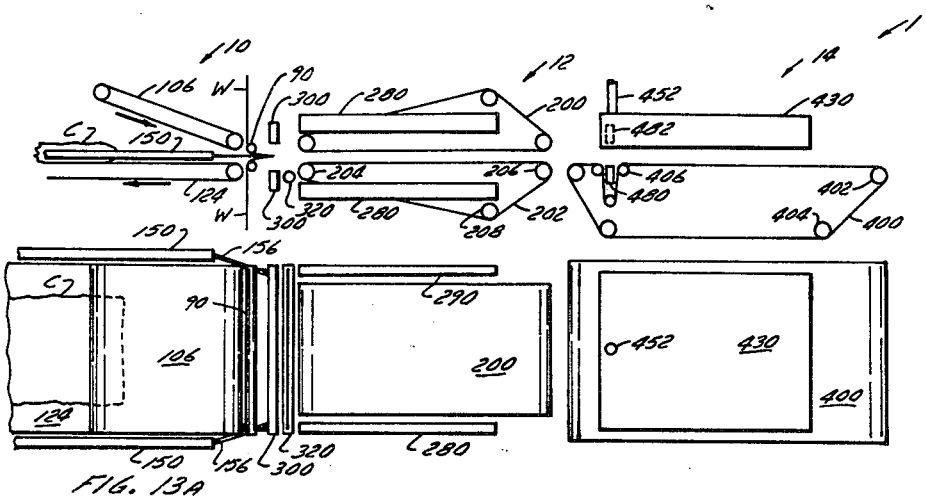
FIGS. 13A to 13F illustrate schematically, the various steps in the operation of the apparatus through its various stages.
Figure 13B:
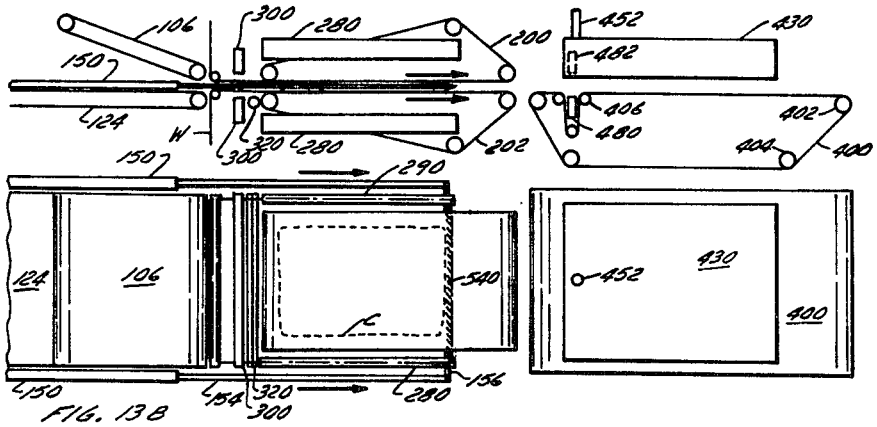
Figure 13C:
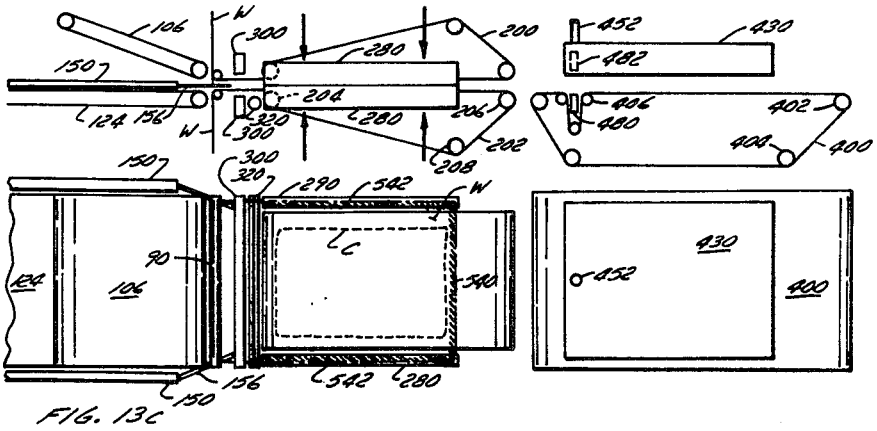

At the onset of the operation, the fingers 156 are placed between the pair of webs W and brought into engagement with the seal 540. In conjunction with the advancement of the commodity C through the discharge end of the belts 106 and 124, the advancing member 154 is actuated to advance the assembly with the fingers 156 and thus advance the sealed web into the assembly 12 and between the spaced apart belts 200 and 202 which then assume control of the commodity within the partially formed wrapper or bag. The commodity, as it is illustrated in FIG. 13B, is shown as being advanced into the assembly 12 and following advancement of the commodity under control of the belts 200 and 202 of the assembly 12, the fingers 156 are moved from engagement and from controlling the partially packaged commodity by the reverse movement of the assembly 154 whereby the fingers, being biased forwardly, are then brought clear of the commodity and returned to the initial position for subsequent advancement of a further operation. At this point, the side sealing assemblies 280 and 290 are actuated to seal the sides of the web and to form a side-sealed and bottom-sealed wrapper or bag, as illustrated in FIG. 13C — the side seal being indicated generally by reference numeral 542.

Figure 13D:
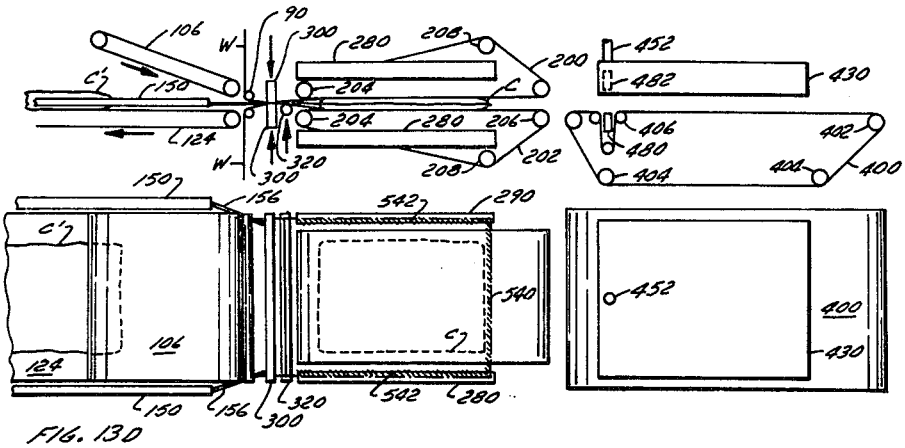

Thereafter, the sealing members 300 are actuated to effect a further seal 540′ for the subsequent operation, and at the same time, the webs in the leading direction (in the direction of movement of the webs) are severed (see FIG. 13D).

Figure 13E:
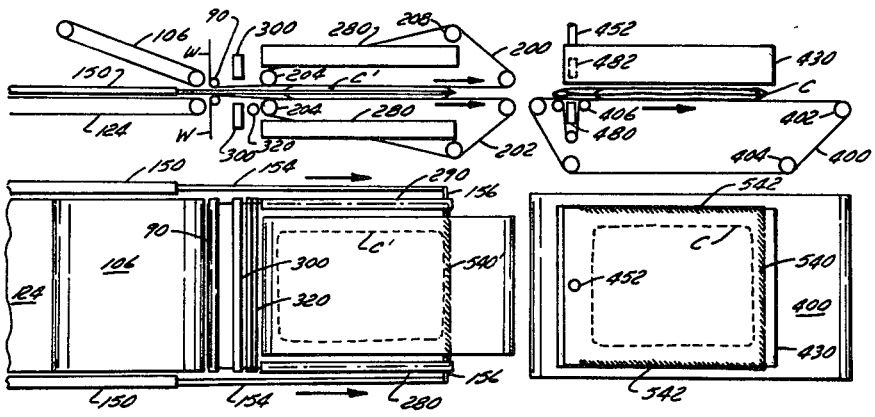
Figure 13F:
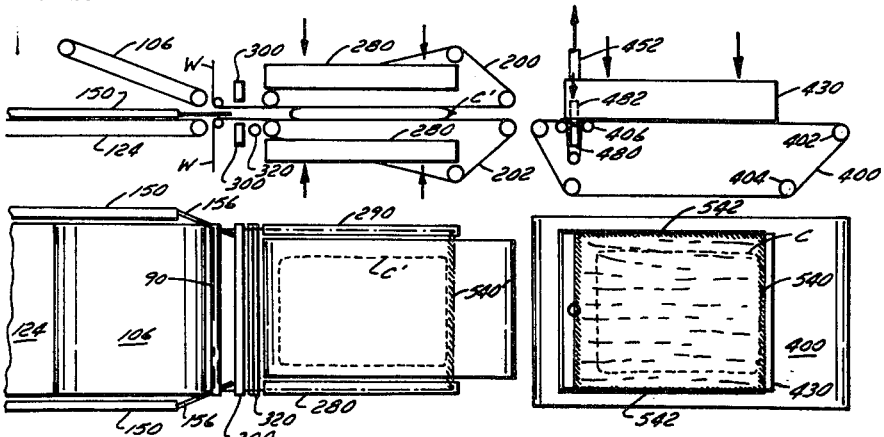

Following the sealing and cutting operation, and referring to FIG. 13E, the severed bag or wrapper unit containing the commodity is advanced into the assembly 14 for final vacuum packaging and sealing. At that point, the housing 430 is lowered once the belt 400 positions the partially wrapped commodity at the desired position within the housing 430. Housing 430 is lowered and a partial vacuum is applied by means of vacuum pump 450. The flexible membrane is then brought into contact with the wrapped commodity, the same is further compressed and air removed from the package or wrapper, following which the final seal is applied by means of sealing heads 480 and 482, as illustrated in FIG. 13F.

The above assemblies indicated by reference numerals 10, 12 and 14, may be operated on an intermittent basis whereby a commodity being fed through the assembly 10 is brought into contact with the webs of material W while a further commodity is being side-sealed in the assembly 12 and a still further commodity is being vacuum packaged in the assembly 14. Thus, each assembly may be operated in a time-intermittent manner through a suitable control device controlling the operation of all three assemblies.

It will be understood that various modifications may be made to the above-described embodiments without departing from the spirit and scope of the invention.

Thus, this invention contemplates that the apparatus and method may be employed in conjunction with other operations such as a manufacturing operation in which the commodities produced from the manufacturing operation are automatically fed into the system of the present invention, to be wrapped. In some cases, it may not be necessary to compress the commodities or put the commodities under vacuum packaging but for most products such as insulation products, garments and the like, this is highly desirable.

We claim:

1. Apparatus for wrapping a commodity comprising means for supplying a pair of opposed lengths of air-impermeable wrapping material each having a pair of opposed free lateral edges, means for placing said pair of lengths of wrapping material in registry, said lengths of wrapping material being secured together along a leading edge to form an open-sided envelope having a closed leading portion, means for advancing said commodity along a fixed path into engagement with said wrapping material between said pair of sheets of wrapping material, means for sealing said opposed free lateral edges of said pair of sheets of wrapping material together to form an envelope having closed sides and a closed leading portion with said commodity therein, means for severing said opposed lengths of wrapping material across the width thereof to form a container length, means for sealing said open trailing end to form a wrapped commodity enclosed in a wrapper.

2. An apparatus as defined in claim 1, further comprising means for advancing said commodity along said fixed path and means for simultaneously advancing said pair of opposed lengths of wrapping material to said means for severing said opposed lengths of wrapping material.

3. An apparatus as defined in claim 1, wherein said means for severing said opposed lengths of wrapping material across the width of said wrapping material comprises means for severing both of said lengths of wrapping material simultaneously.

4. An apparatus as defined in claim 1, further comprising means for vacuum-packaging said commodity in said envelope prior to said means for sealing the open trailing end being actuated to seal the open trailing end.

5. An apparatus as defined in claim 1, wherein said means for supplying a pair of opposed lengths of wrapping material comprises means for supplying a continuous length of wrapping material, and wherein said means for severing said opposed lengths of wrapping material comprises means for severing bag-lengths of said wrapping material from said continuous lengths thereof.

6. An apparatus as defined in claim 1, further comprising means for vacuum-packaging said commodity in said envelope, said vacuum-packaging means comprising means for supporting said envelope in a closed chamber, means for withdrawing air from said closed chamber, and flexible means for being placed in contact with said envelope to evacuate air from said envelope.

7. An apparatus as defined in claim 1, wherein said means for advancing said commodity in a fixed path comprises compression means for compressing said commodity as the commodity is advanced in said fixed path.

8. An apparatus as defined in claim 1, wherein there are included means for maintaining said commodity under compression while said opposed pair of lengths of wrapping material are severed by said means for severing said material.

9. An apparatus as defined in claim 6, wherein said vacuum packaging means comprises a fixed surface and an opposed flexible surface, means for bringing said surfaces into and out of engagement to form therebetween a vacuum chamber, means for evacuating the air from said vacuum chamber, sealing means in said vacuum chamber adapted to seal an open trailing end of said envelope, means for advancing an envelope into said chamber and means for discharging a wrapped commodity from said chamber.

10. An apparatus as defined in claim 1, wherein said means for sealing said opposed free lateral edges comprise a sealing station, means for advancing a commodity into said sealing station from said point at which said means for advancing said commodity along a fixed path into engagement with said wrapping material controls said commodity, means for discharging said commodity from said sealing station, and means for controlling the compression of a commodity in said envelope at said sealing station while said free lateral edges of said wrapping material are sealed togehter.

11. An apparatus as defined in claim 10, wherein said means for advancing said commodity into said sealing station and discharging a wrapped commodity from said sealing station comprises a pair of spaced-apart conveyor belts for maintaining control of the advancement of said commodity and simultaneously retaining said commodity under compression.

12. An apparatus as defined in claim 6, wherein said means for vacuum packaging said commodity includes means for advancing said commodity into said means for vacuum packaging said commodity and for discharging a wrapped commodity from said vacuum packaging means.

13. An apparatus as defined in claim 12, wherein said means for advancing said commodity comprises an endless belt movable through said vacuum packaging means.

14. An apparatus as defined in claim 1, said apparatus comprising an initial compression station adapted to compress a compressible commodity, a sealing station adapted to side seal said opposed lengths of wrapping material and a vacuum packaging and sealing station, said first station including said means for advancing an opposed pair of lengths of wrapping material and said means for advancing said commodity along said fixed path, said side sealing station comprising means for maintaining said commodity after insertion between said opposed lengths of wrapping material, under compression, severing means between said first and second stations for severing a bag length of material from said means for supplying said material, sealing means between said first and second stations for sealing said opposed lengths of wrapping material together transversely to form a closed leading end for a subsequent operation, and means for advancing said commodity from said second station to said vacuum packaging and sealing station.

15. An apparatus as defined in claim 14, wherein said means for advancing said commodity comprises a movable belt, said means for compressing said commodity comprising a pair of spaced-apart converging belts.

16. An apparatus as defined in claim 14 said apparatus including means for intermittently operating said advancing means, said side sealing means and said vacuum packaging and sealing means.

17. A method of wrapping a commodity comprising the steps of supplying a commodity to be wrapped, supplying a pair of opposed lengths of wrapping material each having a pair of opposed free lateral edges, placing said opposed pair of lengths of wrapping material in registry, said lengths of wrapping material having a closed leading end, advancing said commodity along a fixed path into engagement with the wrapping material between the opposed sheets of wrapping material, sealing the free lateral edges of the sheets of wrapping material together to form an envelope having closed sides and a closed leading portion with said commodity therein, severing the opposed lengths of wrapping material across the width thereof to form a container length, and sealing the open trailing end to form a wrapped commodity enclosed in a wrapper.

18. A method as defined in claim 17, wherein the commodity is advanced along said fixed path while said opposed lengths of wrapping material are simultaneously advanced.

19. A method as defined in claim 17, wherein the opposed lengths of wrapping material with said commodity therein are subjected to a vacuum packaging step prior to the open trailing end of the wrapping material being sealed whereby a vacuum packaged commodity is obtained.

20. A method as defined in claim 17, wherein said commodity is subjected to compression prior to insertion between the opposed lengths of wrapping material, said commodity being maintained under compression while said free side edges of said wrapping material are sealed.

21. A method as defined in claim 17, wherein continuous lengths of wrapping material are supplied and which includes the step of severing said opposed layers of wrapping material while sealing the opposed lengths of wrapping material adjacent the point at which said wrapping material is severed on the downstream side of advancement of said commodity.

22. A method as defined in claim 17, comprising the further steps of subjecting said commodity to a compression step, maintaining said commodity under compression while said opposed lengths of wrapping material are side-sealed, subjecting the resulting commodity to a vacuum packaging step by placing said commodity on a fixed surface, contacting said commodity in said envelope with a flexible membrane with said flexible membrane and said fixed surface defining therebetween a vacuum chamber, evacuating air from said chamber and permitting the flexible membrane to compress and evacuate air from the envelope containing said commodity, and upon evacuation of air from said commodity and said envelope, sealing the open trailing end of the envelope to form a vacuum packaged compressed commodity.

23. A method as defined in claim 22, wherein said step of subjecting the commodity to compression comprises the step of placing said commodity between a pair of opposed converging belts, and said step of maintaining the commodity under compression while said side edges of said wrapping material are sealed is carried out by maintaining said commodity under compression under a pair of spaced-apart compression belts.

24. A method as defined in claim 23, wherein said spaced-apart belts are movable whereby the commodity is advanced from said sealing step to said vacuum packaging and sealing step by said movable belts.

* * * * *